US006376993B1

(12) United States Patent
Romanczuk et al.

(10) Patent No.: US 6,376,993 B1
(45) Date of Patent: Apr. 23, 2002

(54) POWER SUPPLY TO XENON ARC LAMP INTERFACE

(75) Inventors: Alexander D. Romanczuk, San Francisco; Mohammad Khan, Fremont, both of CA (US)

(73) Assignee: PerkinElmer Optoelectronics, N.C., Inc., Fremont, CA (US)

( * ) Notice: Subject to any disclaimer, the term of this patent is extended or adjusted under 35 U.S.C. 154(b) by 0 days.

(21) Appl. No.: 09/789,951

(22) Filed: Feb. 20, 2001

(51) Int. Cl.[7] ..... H01J 1/52

(52) U.S. Cl. ..... 315/85; 313/51; 362/416; 439/56

(58) Field of Search ..... 315/85, 289; 361/601, 361/679, 748; 362/226, 416, 433; 439/55, 56; 313/51

(56) References Cited

U.S. PATENT DOCUMENTS

| | | | | |
|---|---|---|---|---|
| 5,036,444 A | * | 7/1991 | Hiles | 362/188 |
| 5,640,061 A | * | 6/1997 | Bornhorst et al. | 307/11 |
| 5,684,340 A | * | 11/1997 | Soler et al. | 307/91 |
| 6,181,077 B1 | * | 1/2001 | Greenland | 315/224 |

* cited by examiner

*Primary Examiner*—Don Wong
*Assistant Examiner*—Thuy Vinh Tran
(74) *Attorney, Agent, or Firm*—Thomas E. Schatzel; Law Offices of Thomas E. Schatzel, A Prof. Corp.

(57) ABSTRACT

An arc lamp system comprises a power supply coupled to a xenon arc lamp through an interface constructed on a heavy printed circuit board. Such plugs directly into an igniter printed circuit board. In turn, a xenon arc lamp module with heatsinks plugs directly onto banana plugs bolted on the interface printed circuit board. Copper traces buried on inner layers of the interface printed circuit board are very wide and heavy, and kept as short as possible.

8 Claims, 4 Drawing Sheets

100
114
lamp module
120
106
108
interface
112
110
exciter
115
116
123
104
118
power
supply
102
122
124 feedback
321
"on"
"replace"
356
358
360
+12V fan supply
351
fan pwr output
352
T3 part
348
gate drive2
332
328
336
T2
337
T4
T3
342
320
338
C10
335
340
334
326
T1
gate drive1
330
BR2
350
354
344
T3 part
J2
J1
igniter circuit
T6
372
322
T5
370
diac
364
366
SG1
368
arc lamp output
362
324
306
318
C6
SC1
C7
308
312
IC1
R5
310
R1
314
BR1
R2
316
304
302
L1
346
T3 part
FS1
C1
TH1
H
N
G
AC input
300

POWER SUPPLY TO XENON ARC LAMP INTERFACE

BACKGROUND OF THE INVENTION

1. Field of the Invention

The invention relates generally to arc lamp based systems, and specifically to the low electromagnetic radiation and low power loss interfacing of power supply systems with xenon arc lamps.

2. Description of the Prior Art

Short arc lamps provide intense point sources of light that allow light collection in reflectors for applications in medical endoscopes, instrumentation and video projection. Also, short arc lamps are used in industrial endoscopes, for example in the inspection of jet engine interiors. More recent applications have been in color television receiver projection systems.

A typical short arc lamp comprises an anode and a sharp-tipped cathode positioned along the longitudinal axis of a cylindrical, sealed concave chamber that contains xenon gas pressurized to several atmospheres. U.S. Pat. No. 5,721,465, issued Feb. 24, 1998, to Roy D. Roberts, describes such a typical short-arc lamp. A typical xenon arc lamp, such as the CERMAX marketed by EGG/ILC Technology (Sunnyvale, Calif.) has a two-legged strut system that holds the cathode electrode concentric to the lamp's axis and in opposition to the anode.

Voltages as high as thirty kilovolts are needed to "ignite" or start a xenon arc lamp. Once current starts to flow, the voltage can be reduced and the current regulated to safe limits. The arc lamps usually start on a first attempt by the igniter, but if that fails several more pulses of high voltage can be issued.

The pulsed nature of the voltages, the high voltages involved, and the current delivered to the arc lamp can all combine to generate strong electromagnetic interference (EMI). Significant impedances can also exist in the wiring that connects the power supply to the arc lamp, and these can dissipate substantial power. In some cases, poor coupling can prevent igniting the lamp on the first strike of the igniter.

SUMMARY OF THE PRESENT INVENTION

It is therefore an object of the present invention to provide an efficient interface between a power supply and a xenon arc lamp.

Briefly, an arc lamp system embodiment of the present invention comprises a power supply coupled to a xenon arc lamp through an interface constructed on a heavy printed circuit board. Such plugs directly into an igniter printed circuit board. In turn, a xenon arc lamp module with heatsinks plugs directly onto banana plugs bolted on the interface printed circuit board. Copper traces buried on inner layers of the interface printed circuit board are very wide and heavy, and kept as short as possible.

An advantage of the present invention is that a xenon arc lamp system is provided with an interface that improves EMI and lamp operation.

These and other objects and advantages of the present invention will no doubt become obvious to those of ordinary skill in the art after having read the following detailed description of the preferred embodiment which is illustrated in the drawing figures.

IN THE DRAWINGS

DETAILED DESCRIPTION OF THE PREFERRED EMBODIMENT

Figure 1:
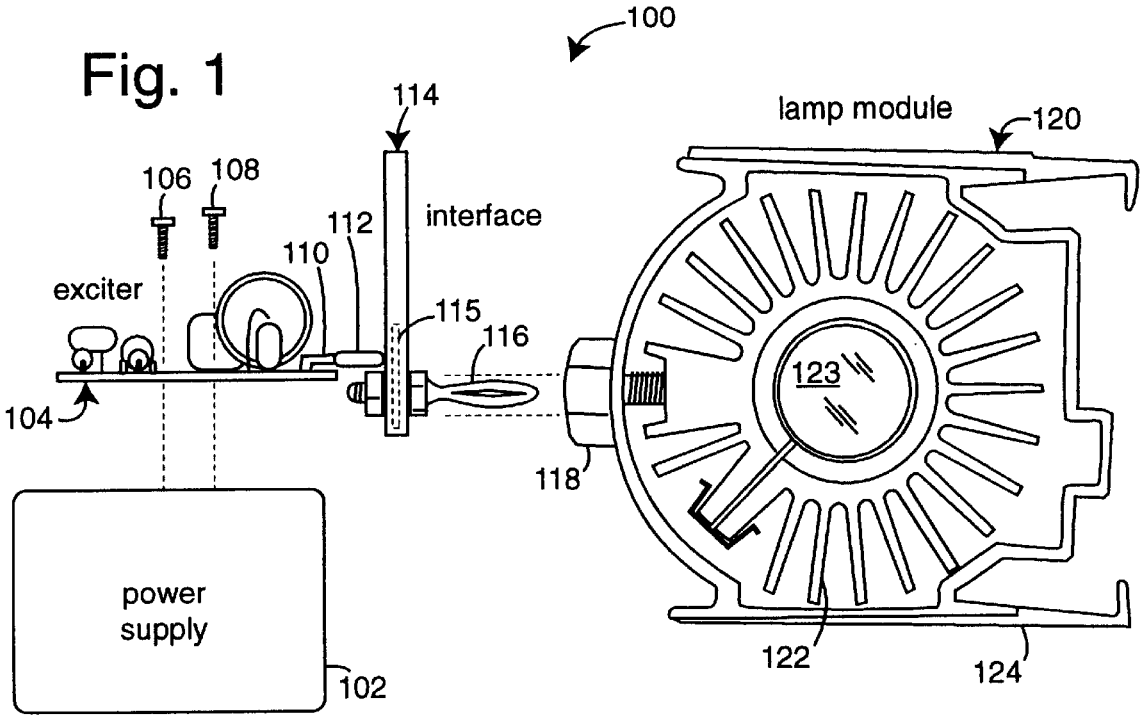
FIG. 1 is a side view of an arc lamp system embodiment of the present invention.

FIG. 1 represents an arc lamp system embodiment of the present invention, and is referred to herein by the general reference numeral 100. The system 100 comprises a power supply 102 that feeds DC electrical power to an exciter 104. A pair of machine screws 106 and 108 are used to mechanically secure the printed circuit board (PCB) of the exciter 104 and electrically connect it to the power supply 102. A pair of output connections (±) are represented by a male spade connector 110 and a female spade connector 112. These provide igniter and normal operating power to an interface PCB 114. A pair of buried inner circuit traces, e.g., represented by a copper foil 115, independently connect the respective spade connectors on the input slide (left in FIG. 1) through to the output side (right in FIG. 1). A pair of (±) output connections is represented by a banana plug 116. These plug into a pair of female banana connectors 118 on a removable lamp module 120. A pair of cathode and anode aluminum heatsinks 122 provide an electrical connection to and cooling of an arc lamp 123. All this is housed in a plastic or epoxy molding 124 that helps channel a cooling forced-air flow, and provides high-voltage insulation from chassis ground. The lamp module is typically four inches cubed, and weighs twenty-eight ounces.

The interface PCB 114 is subject to a lot of mechanical stress caused by plugging and unplugging the lamp module 120, so heavier PCB material is used. For example, 0,125" thick epoxy laminate type G10-FR4. The exciter PCB 104 is subject to less mechanical abuse, and can be a much lighter-duty 0.0625" G10-FR4 material.

Figure 2:
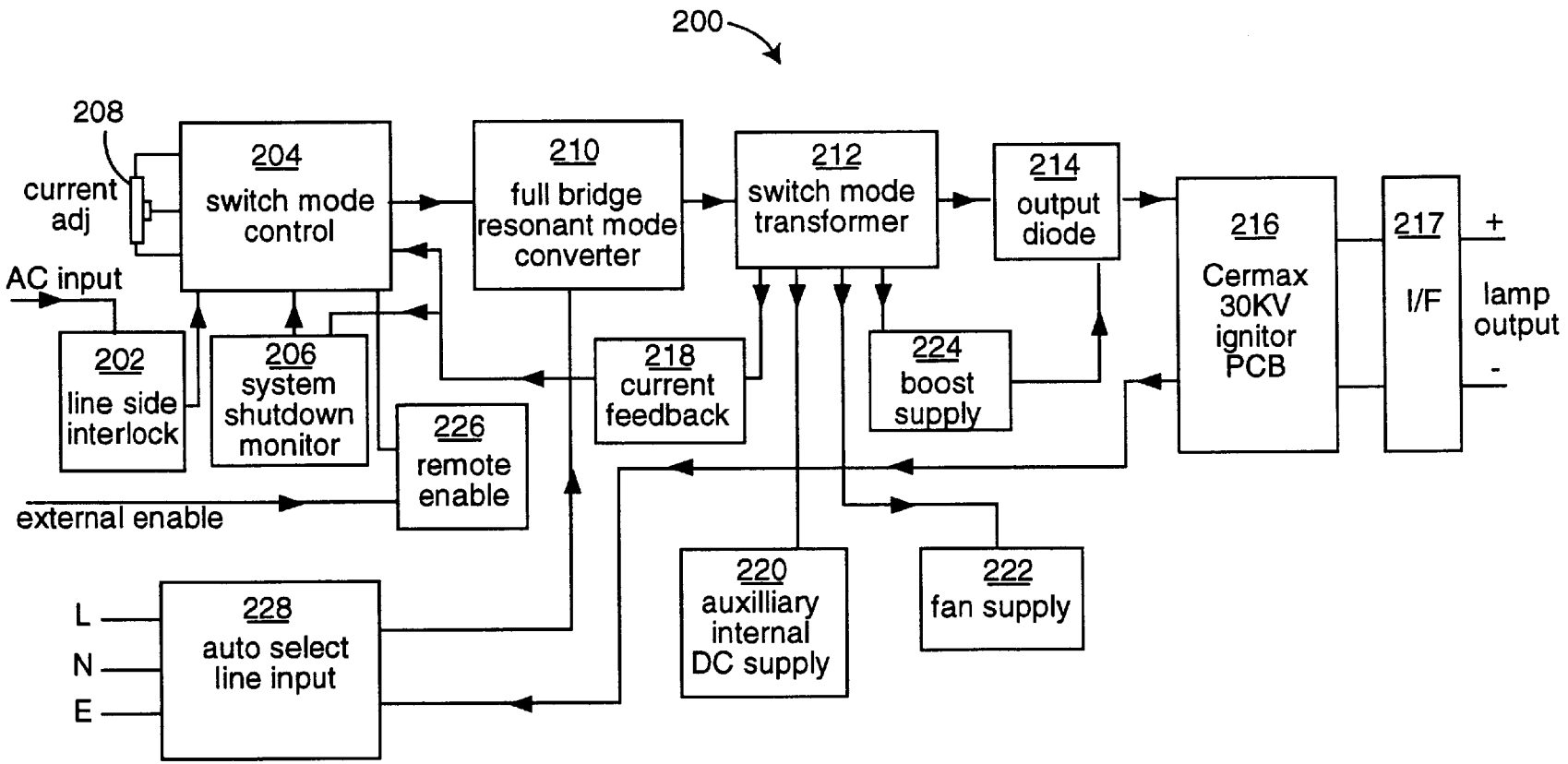
FIG. 2 is a functional block diagram of an arc lamp power supply embodiment of the present invention.

FIG. 2 represents a power supply embodiment of the present invention for a high-intensity short arc lamp, and is referred to herein by the general reference numeral 200. Utility power is input (AC-in) through a line-side safety interlock 202. A switch mode controller 204 receives the AC-input and control signals from a system shut-down monitor 206. A lamp-current adjustment 208 is provided. A full-bridge resonant mode converter 210 drives a switch-mode transformer 212. An output diode 214 converts the AC power from the switch-mode transformer 212 into direct current. A CERMAX 30KV igniter 216 provides a starting pulse needed by an arc lamp through an interface board 217.

In typical embodiments of the present invention, the switch-mode transformer 212 is used to power a lamp-current feedback 218, an auxiliary power supply 220, a fan power supply 222, and a boost power supply 224. A remote enable 226 allows external lamp control A line-input auto-selector 228 automatically maintains its DC rectified output at a near constant voltage despite being connected to a variety of mains-voltages. It does this by changing between half-wave and full-wave operating modes.

In alternative embodiments of the present invention, the power supply 200 automatically shuts down in a failsafe condition should the lamp fail to ignite after five seconds of turn on. In operation, the lamp is ignited by one trigger pulse. Too many trigger pulses being needed indicates a problem with the lamp. Once the lamp ignites, a heavy DC electrode current will flow. Too high a voltage across the lamp, or too high a current during operation can also signal trouble. The power supply 200 preferably shuts down automatically in a failsafe condition should the lamp develop a short circuit, or if the cooling fan loses its operating power. Alternatively, power supply embodiments of the present invention automatically shut down in a failsafe condition when the average lamp load current exceeds a safe level, e.g., 25.0 amps.

Figure 3:
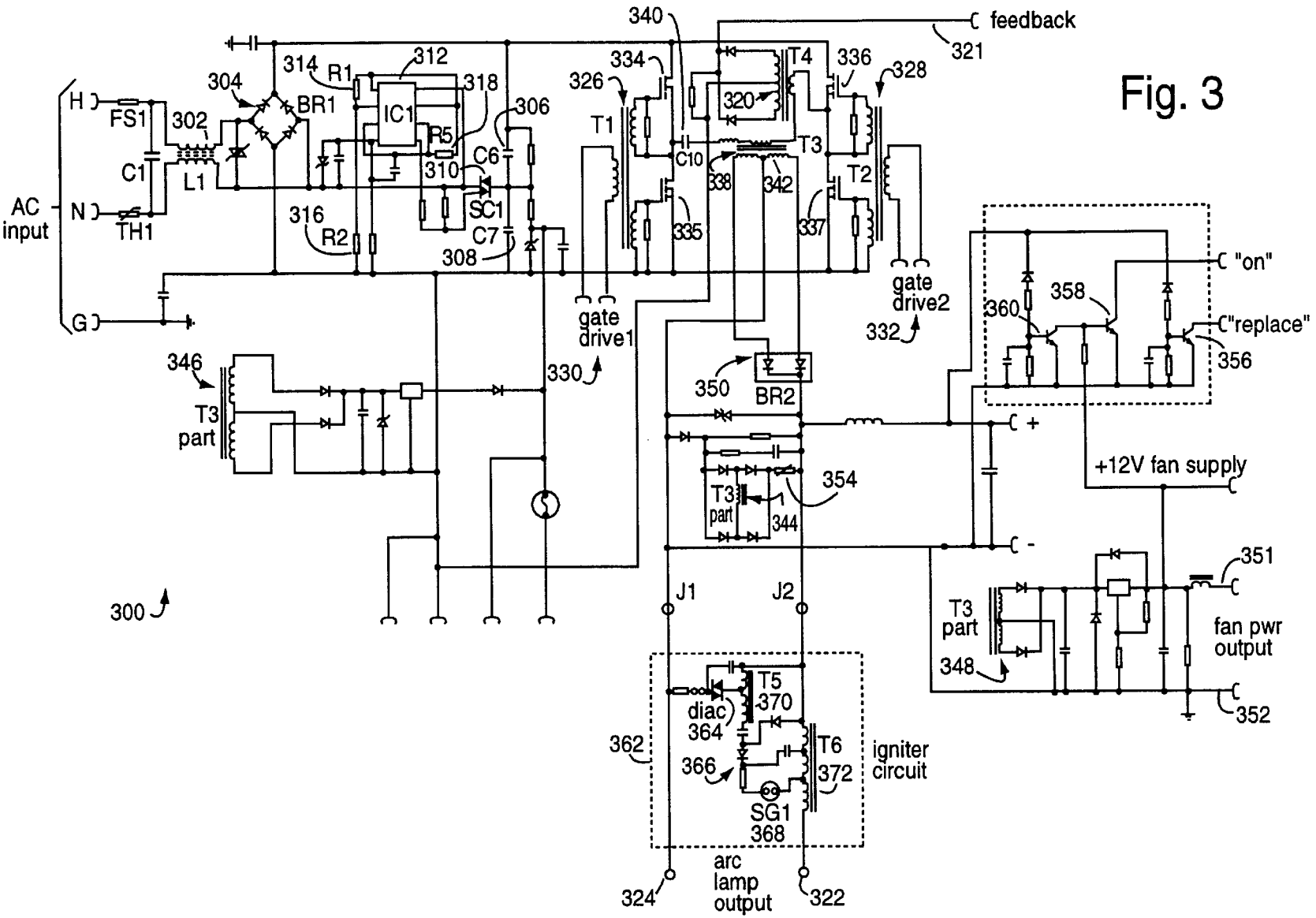
FIG. 3 is a schematic diagram of a full bridge resonant converter (FBRC) power supply embodiment of the present invention.

FIG. 3 represents a full bridge resonant converter (FBRC) power supply embodiment of the present invention, and is referred to herein by the general reference numeral 300. Such FBRC power supply is preferably used as a power supply for a high-intensity short arc lamp. The general specifications preferred for such power supply are listed in Table I.

TABLE I

| Topology | Full Bridge Resonant Mode Converter |
|---|---|
| Switching Frequency | 250 KHz ± 10% |
| Line Operating Voltage | 90–132, 180–264 VAC |
| Max Input Current | 6A |
| Output Current Range | 4–24 A |
| Trigger Voltage | 25–35 KV |
| Boost Voltage | 270–300 V DC |
| Fan Output Voltage | +12 V DC @ 1 A Max |
| Features: | Auto shut down >24 A |
| | Remote Enable |
| | Lamp ON Indication |
| | Lamp Replace Indication |
| Regulatory requirements: | UL2601-1, CSA222 No 6061 |
| | UL3101 No 1010-1 CB Certificate |

Referring now to the schematic of FIG. 3, AC-mains utility power is input to the power supply 300 through a filter choke (L1) 302 and is rectified by a bridge rectifier (BR1) 304. A DC operating voltage of +400V is obtained from bridge rectifier (BR1) 304 and across filter capacitors (C6, C7) 306 and 308. Bridge rectifier (BR1) 304 can be switched to operate as either a full-wave or half-wave bridge by a silicon controlled rectifier (SCR1) 310. Which mode is used depends on the input line input voltage in con junction with the auto select line input.

The objective of switching between full-wave or half-wave bridge operation is to produce about the same DC operating voltage of about +400V across filter capacitors (C6, C7) 306 and 308 for either 320VAC or 230VAC inputs. Silicon controlled rectifier (SCR1) 310 is controlled by a universal voltage monitor (UVM) integrated circuit (IC1) 312, e.g., a Motorola type MC34161. IC1 has two level-comparators that are each referenced to an internal "1V27" standard. Two resistors (R1, R2) 314 and 316 are used to set a voltage threshold "+Ve" that causes the half-wave to full-wave changeover to occur at an AC-input of about 332VAC. A second threshold is used for the full-wave to half-wave changeover, and is determined by a resistor (R5) 318. Therefore, SCR1 forces DB1, C6, and C7 to operate in a full-wave bridge mode at AC-input line voltages of 90-132VAC and to a half-wave mode at AC-input line voltages of 380-265VAC.

A current-sense transformer (T4) 320 allows the output load to be sampled. A current control loop with a voltage proportional to the lamp current is obtained from the secondary winding of T4. Such voltage is rectified and output on a feedback terminal 321. The arc lamp powered by the power supply 300 is connected across output load terminals 322 and 324. Such arc lamp may be of the CERMAX type marketed by. EGG/ILC Technology (Sunnyvale, Calif.).

A "resonant-bridge" is formed by transformers (T1, T2) 326 and 328. Inputs from the switch mode controller illustrated in FIG. 2 are received at a gate-drive-one input 330 and gate-drive-two input 332.

A resonant mode converter is constructed by controlling the resonant-bridge with two totem-pole pairs of MOSFET transistors (TR1, TR2, TR3, TR4) 334–337, e.g., type IRFP450 MOSFET devices. A resistor is connected between the source and gate of each MOSFET device to reduce parasitic turn-on. Transformers T1 and T2 control the resonant bridge and output anti-phase pulses. A resonant part of the circuit which operates at 250KHz±ten percent comprises a switch-mode transformer (T3) 338, the primary winding of transformer (T4.) 320, and a capacitor (C10) 340.

The switch-mode transformer (T3) 338 has four secondary windings: a main output winding 342 that produces 31VAC, a boost output winding 344 that produces 200VAC, an auxiliary supply winding 346 that produces 30VAC, and a fan supply winding 348 that produces 30VAC (all for a nominal 240VAC line input). The main winding 342 consists of nine turns, center-tapped, and is connected to a 300A, 400V bridge rectifier (BR2) 350, e.g., a type MUR3040. BR2 preferably has a peak rectified forward current of 30A@345° C., and is mounted on a ceramic heat-sink.

The boost output winding 344 helps produce a 300VDC boost voltage that is used to initiate the arc lamp. The fan winding 348 delivers a maximum of 30VAC and is half-wave rectified and filtered for use by a fan connected to a pair of fan output terminals 351 and 352.

The 300V DC boost voltage is only required during ignition of the arc lamp. To ensure this voltage is afterwards isolated from the output, a positive temperature coefficient (PTC) thermistor (PT1) 354 is used, e.g. 3,000 ohms at 25° C. Once the arc lamp has struck, the boost voltage will become isolated because the resistance of thermistor (PT1) 354 will greatly increase as it passes current.

An external light emitting diode (LED) to indicate the lamp needs replacing is connected to an open-collector NPN-transistor 356. The "rep lace lamp" warning is given when the operating voltage across the lamp output terminals 322 and 324 exceed some threshold, e.g., 38VDC. As a CERMAX lamp ages its operating voltage will increase. This is always associated with a worn out lamp. The base of transistor 356 will become forward biased by a simple voltage divider connected across lamp output terminals 322 and 324. If the lamp connected between output terminals 322 and 324 is on at all, a transistor 358 will switch on and drive another external LED indicator, this one for "lamp on". A transistor 360 will prevent transistor 358 from switching on as long as the voltage across output terminals 322 and 324 is too high, indicating a lamp that is not connected or has not been ignited. Such LED, indications can be placed remotely at convenient observation points in the user's application. Both of these LED drivers are primary side isolated.

The igniting of CERMAX lamps requires a boost voltage of at least 250V DC be applied together with series-induced trigger-pulses of 25–30KV A trigger circuit 362 supplies just these voltages. It comprises a DIAC 364, a charge pump network 366, a spark gap (SG1) 368, and autoformer (T5) 370. When a 300V DC boost voltage is applied across the DIAC 364, a pulse is sent through the autoformer (T5) 370 and feeds into the charge-pump network 366. When the pulse voltage reaches 6,000 volts, spark gap (SG1) 368 will break down and cause a 30,000 volt pulse two-hundred nanoseconds wide to be generated in an autoformer (T6) 372. This will appear in series with the boost voltage at the output terminals 322 and 324 and initiate the CERMAX lamp.

Figure 4:
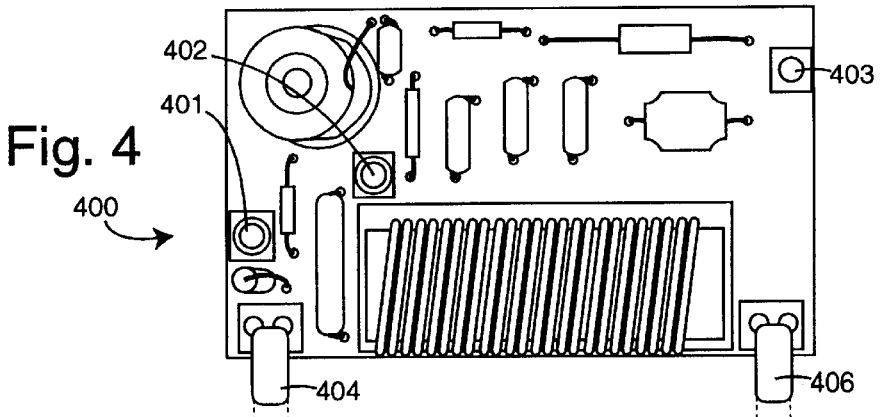
FIG. 4 is a diagram representing an igniter that was built and tested.

FIG. 4 represents an igniter 400 that was built and tested. Its PCB was mounted to a power supply with three screws, e.g., at plated-through holes 401–403. Holes 401 and 402 provide (±) power input. A pair of male spade connectors 404 and 406 provide output power connections, e.g., to an interface board 500 in FIGS. 5A and 5B. These plug into a pair of female spade connectors 502 and 504. Electrical power is conducted inside a thick laminate PCB material 506 by respective patterned conducting foils 508 and 510. In one implementation that provided good results, foil 508 was about 0.875" square and foil 510 was about 0.875" by 2.5". A number of mounting holes 511–515 provide for support fasteners. A pair of banana plugs 516 and 518 provide output power to a CERMAX lamp, and are typically set apart from one another by 1.5".

Figure 5A:
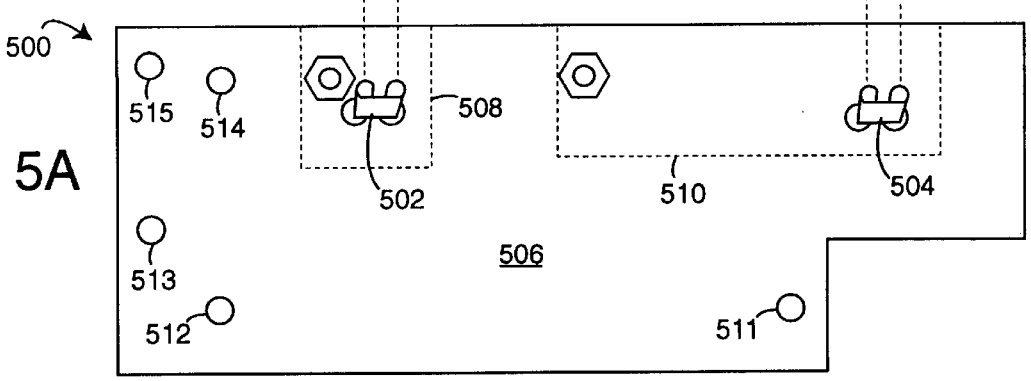
FIGS. 5A and 5B are respectively top and bottom views of an igniter that was built and tested in one embodiment of the present invention.
Figure 5B:
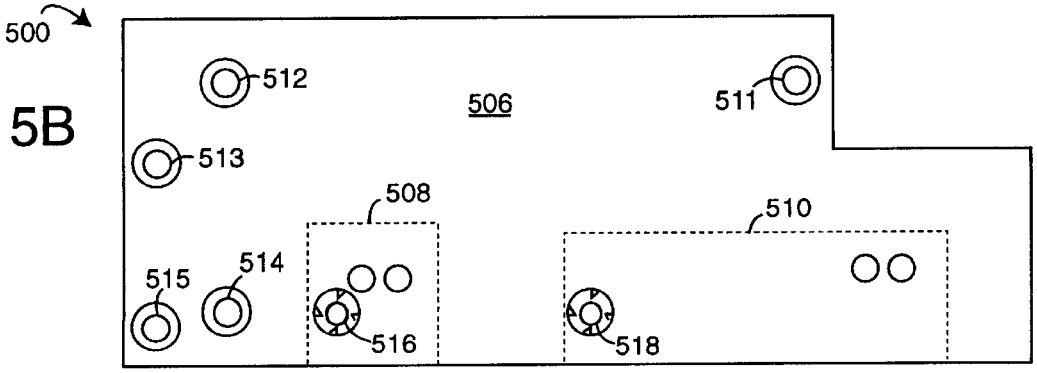

It is critical to the present invention to interconnect the CERMAX lamp and the igniter/power supply with an interface board like that shown in FIGS. 5A and 5B. Simple wire connections radiate too much EMI and dissipate too much power, e.g., by virtue of the poor and uncontrolled impedance matches that result.

In general, arc-lamp power supply to arc-lamp interface embodiments of the present invention include a printed circuit board (PCB) for providing mechanical support of a modular arc lamp assembly, a pair of power input connectors on a first side of the PCB for connecting to an arc-lamp exciter, a pair of power output connectors on a second side of the PCB that are positioned for a sliding connection to the modular arc lamp assembly, and a pair of patterned copper foils disposed in the PCB and each providing a powerplane-type connection between corresponding ones of the pairs of input and output power connectors. The principle advantages of this is electromagnetic interference (EMI) is reduced and power transfer efficiency is improved. The pair of patterned copper foils are preferably about 0.75 inches wide, and lie within a common plane. As such, they are on-edge to one another. As shown in FIG. 1, the pair of patterned copper foils lie within a common plane and are normal to a printed circuit board base for the arc-lamp exciter. The preferred power input connectors comprises spade-type connectors to allow dissasembly of the exciter from the PCB. The preferred power output connectors comprises banana-type connectors to allow removal of the modular lamp assembly from the PCB. The PCB is preferably about 0,125" thick and comprises G10-FR4 fiberglass-epoxy material. In an alternative embodiment of the present invention, the pair of patterned copper foils each comprise two separate parallel copper foils patterned in the same shapes on both sides of the PCB and are connected together at each end by the input and output power connectors.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. An arc-lamp power supply to arc-lamp interface, comprising:

a printed circuit board (PCB) for providing mechanical support of a modular arc lamp assembly;

a pair of power input connectors on a first side of the PCB for connecting to an arc-lamp exciter;

a pair of power output connectors on a second side of the PCB and positioned for a sliding connection to said modular arc lamp assembly; and a pair of patterned copper foils disposed in the PCB and each providing a powerplane-type connection between corresponding ones of the pairs of input and output power connectors;

wherein, electromagnetic interference (EMI) is reduced and power transfer efficiency is improved.

2. The interface of claim 1, wherein:

the pair of patterned copper foils are about 0.75 inches wide.

3. The interface of claim 1, wherein:

the pair of patterned copper foils lie within a common plane and are on-edge to one another.

4. The interface of claim 1, wherein:

the pair of patterned copper foils lie within a common plane and are normal to a printed circuit board base for said arc-lamp exciter.

5. The interface of claim 1, wherein:

the pair of power input connectors comprises spade-type connectors to allow dissasembly of said exciter from the PCB.

6. The interface of claim 1, wherein:

the pair of power output connectors comprises banana-type connectors to allow removal of said modular lamp assembly from the PCB.

7. The interface of claim 1, wherein:

the PCB is about 0.125" thick and comprises G10-FR4 fiberglass-epoxy material.

8. The interface of claim 1, wherein:

the pair of patterned copper foils each comprises two separate parallel copper foils patterned in the same shapes on both sides of the PCB and connected together at each end by the input and output power connectors.

* * * * *